US007695259B2

(12) United States Patent
Miller

(10) Patent No.: US 7,695,259 B2
(45) Date of Patent: Apr. 13, 2010

(54) ROTARY FLUID PRESSURE DEVICE WITH MODULAR MULTI-SPEED CONTROL MECHANISM

(75) Inventor: Andrew T. Miller, Savage, MN (US)

(73) Assignee: Eaton Corporation, Cleveland, OH (US)

( * ) Notice: Subject to any disclaimer, the term of this patent is extended or adjusted under 35 U.S.C. 154(b) by 505 days.

(21) Appl. No.: 11/524,752

(22) Filed: Sep. 21, 2006

(65) Prior Publication Data

US 2008/0075617 A1 Mar. 27, 2008

(51) Int. Cl.
*F03C 2/00* (2006.01)
*F03C 4/00* (2006.01)

(52) U.S. Cl. ..... 418/61.3

(58) Field of Classification Search ..... 418/61.3, 418/1, 166, 171, 15
See application file for complete search history.

(56) References Cited

U.S. PATENT DOCUMENTS 4,715,798 A * 12/1987 Bernstrom ..... 418/61.3
4,756,676 A * 7/1988 Bernstrom ..... 418/61.3
5,137,438 A * 8/1992 Miller ..... 418/61.3
5,593,296 A * 1/1997 Bernstrom et al. ..... 418/61.3
6,068,460 A * 5/2000 Haarstad et al. ..... 418/61.3
6,099,280 A 8/2000 Bernstrom et al.

* cited by examiner

*Primary Examiner*—Theresa Trieu
(74) *Attorney, Agent, or Firm*—Sonu N. Weaver

(57) ABSTRACT

A rotary fluid pressure device (11) includes a plate assembly (17) having a plate member (71) and at least one cover plate (105), which defines a mounting surface (107) adapted for sealing engagement with an exterior surface (77) of the plate member (71), or at least one control valve assembly (105), which defines a mounting surface (117) adapted for sealing engagement with the exterior surface (77). The cover plate assembly (105), when mounted to the exterior surface (77), provides fluid communication between openings (95, 97) of upstream and downstream fluid passages (91, 93), thereby providing single-speed functionality. The control valve assembly (115), when mounted to the exterior surface (77), provides selective fluid communication between the openings (95, 97) of upstream and downstream fluid passages (91, 93), thereby providing multi-speed functionality.

27 Claims, 15 Drawing Sheets

LO-SPEED MODE

HI-SPEED MODE

ROTARY FLUID PRESSURE DEVICE WITH MODULAR MULTI-SPEED CONTROL MECHANISM

BACKGROUND OF THE DISCLOSURE

The present invention relates to rotary fluid pressure devices, and more particularly, to such devices that are provided with a single-speed option and a multi-speed option.

Although the present invention can be used in connection with various pump and motor configurations that include various types of fluid displacement mechanism, such as a cam lobe type, it is especially advantageous when used with fluid motors having fluid displacement mechanisms of the gerotor type and will be discussed in connection therewith. While the present invention may also be used in connection with fluid motors having various types of valve arrangements, it is especially advantageous when used in connection with fluid motors of the disc valve type. Therefore, the present invention will be discussed in connection with disc valve gerotor motors without intending to limit the scope of the invention.

Fluid motors of the type utilizing a gerotor displacement mechanism to convert fluid pressure into a rotary output are widely used in a variety of low-speed, high-torque commercial applications, such as skid-steer loaders. One common use for fluid motors in low-speed, high torque commercial applications is vehicle propulsion, wherein the vehicle includes an engine driven pump which provides pressurized fluid to a pair of fluid motors, with each motor being associated with one of the drive wheels.

For many years, vehicle manufacturers have provided vehicles with the option of fluid motors capable of operation in a low-speed, high-torque mode only (single-speed motors) or with fluid motors capable of operation in both low-speed, high-torque mode and high-speed, low-torque mode (two-speed motors). While choosing between a vehicle with either single-speed propulsion motors or two-speed propulsion motors for vehicle applications enables the vehicle manufacturer's customers to choose the best vehicle for their particular needs, this propulsion motor option creates some difficulties for the vehicle manufacturers. One such difficulty is that the manufacturer is required to maintain two part numbers for motors used on the same vehicle model. In other words, the manufacturer must maintain part numbers for a single-speed version of a propulsion motor, as well as a two-speed version of the propulsion motor in order to accommodate the option choice of the customer. While the single-speed motor and the two-speed motor are not identical given that one is capable of only single-speed functionality and the other is capable of two-speed functionality, the motor mounting, displacement, valve type, output shaft, and porting type are typically the same.

Another difficulty that vehicle manufacturers have in providing this option to customers is that this option requires manufacturers to have accurate build orders early in the assembly process. Typically, fluid motors are assembled onto the vehicle frame very early in the assembly process. Many times, the fluid motors are installed on the vehicle frame before the build orders have been placed. Therefore, if the assemblers are building single-speed versions of a vehicle and incoming build orders, which were submitted after assembly had started, require two-speed versions of the vehicle, the single-speed fluid motors must be removed from the partially assembled vehicle and replaced with two-speed fluid motors. This becomes difficult because after the fluid motors and other vehicle components have been assembled to the frame, access to the mounting surfaces of the fluid motors is limited.

In addition to these difficulties, some vehicle manufacturers receive requests from customers to "upgrade" their current vehicle, which is configured for single-speed functionality, to a vehicle with two-speed functionality. While vehicle manufacturers have done this successfully in the past, the removal and replacement of the single-speed fluid motors with two-speed fluid motors is a labor intensive task.

BRIEF SUMMARY OF THE INVENTION

Accordingly, it is an object of the present invention to provide a rotary fluid pressure device that overcomes the above discussed disadvantages of the prior art.

It is another object of the present invention to provide a method for conversion of a rotary fluid pressure device that overcomes the above discussed disadvantages of the prior art.

In order to accomplish the above mentioned objects, the present invention provides a rotary fluid pressure device comprising a housing means defining a fluid inlet and a fluid outlet, a fluid energy-translating displacement means including a first member and a second member, which is operably associated with the first member. The first member and the second member of the fluid energy-translating displacement means have relative movement and interengage to define a plurality N of expanding and contracting fluid volume chambers in response to that relative movement. The rotary fluid pressure device also includes a valve means that cooperates with the housing means to provide fluid communication between the fluid inlet and the expanding volume chambers, and between the fluid outlet and the contracting volume chambers. The valve means comprises a stationary valve member fixed to be non-rotatable relative to the housing means, and a moveable valve member, operable to move relative to the stationary valve member. A selector plate member defines a plurality N of upstream fluid passages in commutating fluid communication with the valve means and a plurality N of downstream fluid passages, with each of the downstream fluid passages being in open fluid communication with one of the plurality of volume chambers. A plurality of upstream fluid passages being in direct, relatively unrestricted, continuous fluid communication with a plurality of downstream fluid passages.

The rotary fluid pressure device is characterized by a selector plate assembly including the selector plate member and an assembly selected from the group consisting of a cover plate assembly and a control valve assembly. The selector plate member includes a plurality M of upstream passages, which are in open fluid communication with a plurality M of upstream fluid passages, and have an opening in an exterior surface of the selector plate member. The selector plate member also includes a plurality M of downstream passages which are in fluid communication with a plurality M of downstream fluid passages, and have an opening in the exterior surface of the selector plate member. The cover plate assembly defines a surface that is in sealing engagement with the exterior surface of the selector plate member with the cover plate assembly providing unrestricted fluid communication between the upstream passages and the downstream passages in the selector plate member. The control valve assembly defines a surface that is in sealing engagement with the exterior surface of the selector plate member with the control valve assembly being operable in a first position to provide relatively unrestricted flow between the upstream passages and the downstream passages in the selector plate member, and operable in a second position to block fluid communication between the upstream passages and the downstream passages in the selector plate member.

In order to further accomplish the objects mentioned above, the present invention also provides a method for converting a single-speed rotary fluid pressure device to a multi-speed fluid pressure device wherein the rotary fluid pressure device is of the type comprising a housing means, which defines a fluid inlet and a fluid outlet, and a fluid displacement means, which includes a first member and a second member, with the second member being operably associated with the first member. The first member and second member have relative movement and interengage to define a plurality of expanding and contracting fluid volume chambers in response to said relative movement. The rotary fluid pressure device also includes a valve means, which cooperates with the housing means to provide fluid communication between the fluid inlet and the expanding volume chambers, and a selector plate assembly which includes a selector plate member.

The method for converting a single-speed rotary fluid pressure device to a multi-speed fluid pressure device is characterized by removing at least one cover plate assembly from at least one exterior surface of the selector plate member, with the exterior surface defining a plurality of openings in fluid communication with a plurality of upstream passages in the selector plate member and a plurality of openings in fluid communication with a plurality of downstream passages in the selector plate member, providing at least one control valve assembly comprising a surface, and mounting the surface of the control valve assembly to the exterior surface of the selector plate member, with the control valve being operable in a first position to provide relatively unrestricted fluid communication between the upstream passages and the downstream passages in the selector plate member, and operable in a second position to block fluid communication between the upstream passages and the downstream passages in the selector plate member.

DETAILED DESCRIPTION OF THE PREFERRED EMBODIMENT

Figure 1:
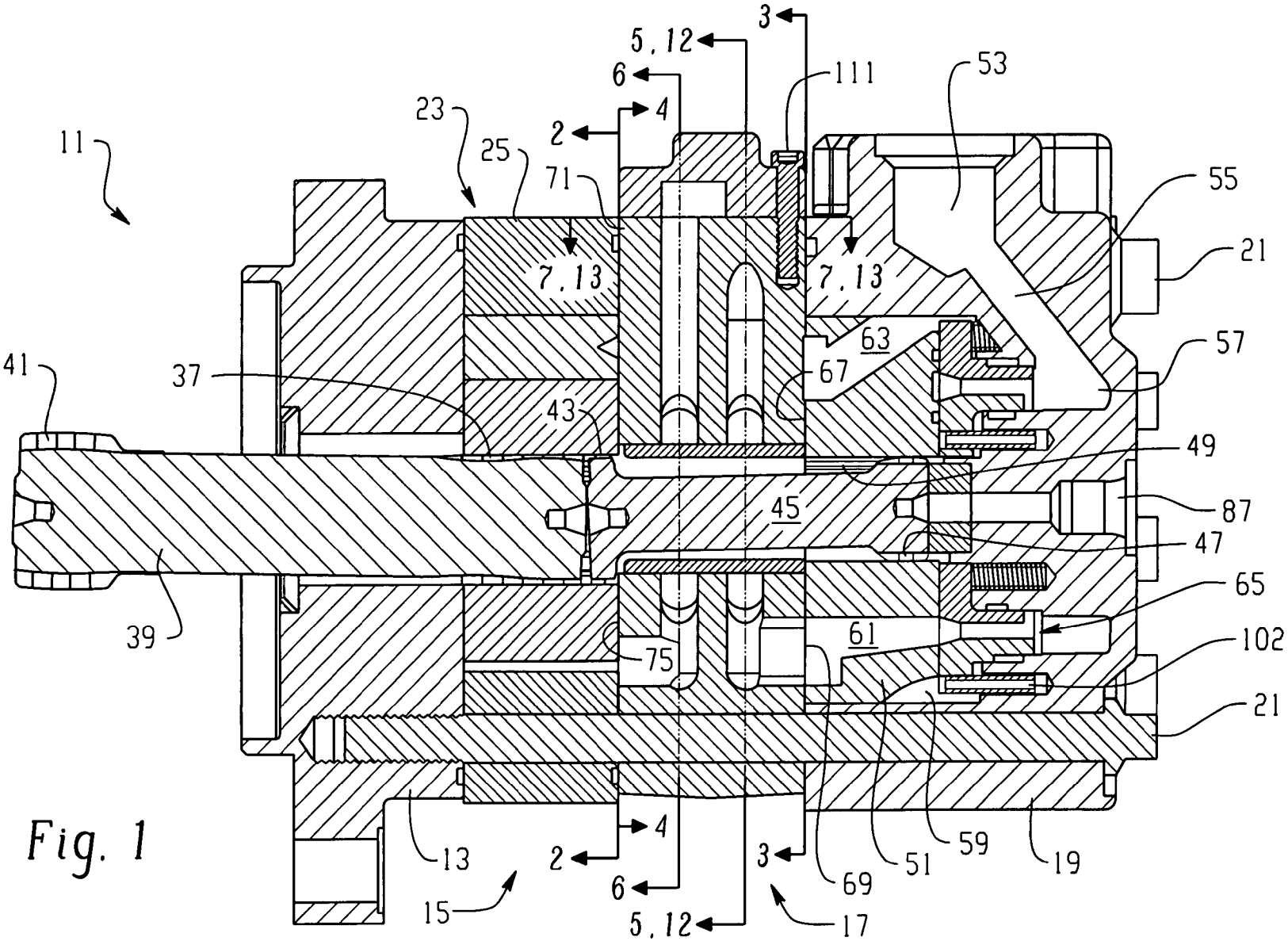
FIG. 1 is an axial cross-sectional view of a single-speed rotary fluid pressure device.

Referring now to the drawings, which are not intended to limit the invention, FIG. 1 is an axial cross-section of a bi-directional disc-valve motor made in accordance with the present invention. The disc-valve motor, generally designated 11, includes a mounting plate 13, a gerotor displacement mechanism, generally designated 15, a selector plate assembly, generally designated 17, and a valve housing 19. The sections are held together in tight sealing engagement by means of a plurality of bolts 21, which are in threaded engagement with the mounting plate 13.

Figure 2:
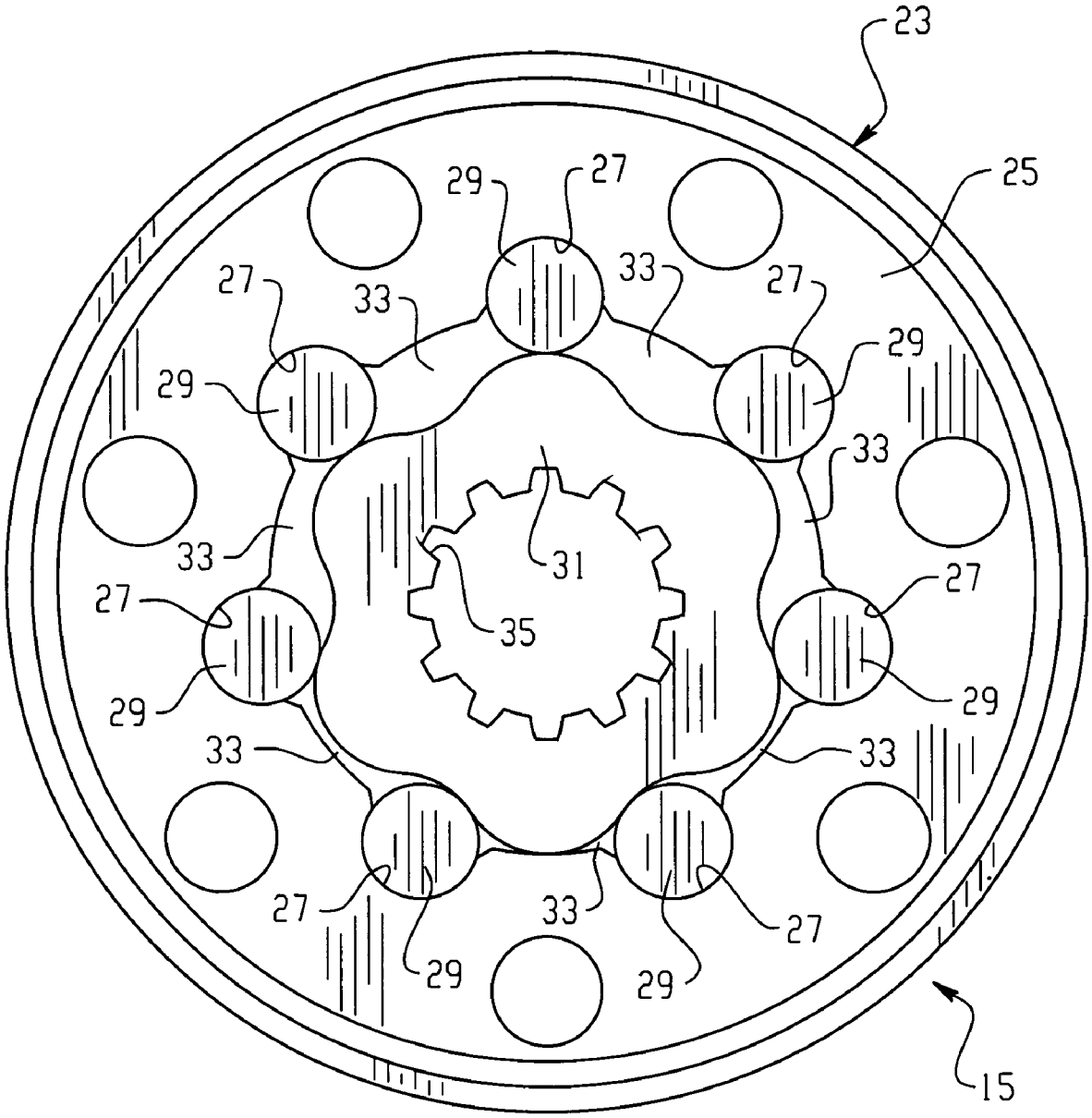
FIG. 2 is a transverse, plain view of the fluid displacement mechanism, taken on line 2-2 of FIG. 1.

Referring now to FIGS. 1 and 2, the gerotor displacement mechanism 15 is well known in the art and will therefore be described only briefly herein. More specifically, in the subject embodiment, the gerotor displacement mechanism 15 is a Geroler® displacement mechanism comprising an internally toothed ring assembly 23. The internally toothed ring assembly 23 comprises a stationary ring member 25 which defines a plurality of generally semi-cylindrical openings 27. Rotatably disposed within each of the semi-cylindrical openings 27 is a cylindrical member 29, as is now well known in the art. Eccentrically disposed within the internally toothed ring assembly 23 is an externally toothed rotor member 31, hereinafter referred to as the "star" member, typically having one less external tooth than the number of cylindrical members 29, thus permitting the star member 31 to orbit and rotate relative to the internally toothed ring assembly 23. The relative orbital and rotational movement between the internally toothed ring assembly 23 and the star member 31 defines a plurality of expanding and contracting volume chambers 33. The star member 31 defines a set of internal splines 35 formed at the inside diameter of the star member 31. The internal splines 35 of the star member 31 are in engagement with a set of external, crowned splines 37 on a main drive shaft 39. Disposed at the opposite end of the main drive shaft 39 is another set of external, crowned splines 41, for engagement with a set of internal splines (not shown) in a customer-supplied output device, such as a shaft (not shown).

Also in engagement with the internal splines 35 of the star member 31 is a set of external splines 43 formed about one end of a valve drive shaft 45 which has, at its opposite end, another set of external splines 47 in engagement with a set of internal splines 49 formed about the inner periphery of a rotatable valve member 51. The valve member 51 is rotatably disposed within the valve housing 19, and the valve drive shaft 45 is splined to both the star member 31 and the rotatable valve member 51 in order to maintain proper valve timing, as is generally well known in the art.

Referring again to FIG. 1, the valve housing 19 defines a first fluid port 53 which is in open fluid communication with a first fluid passage 55. The first fluid passage 55 is in open fluid communications with an annular fluid chamber 57. The valve housing 19 further defines a second fluid port (not shown) which is in open fluid communication with a second fluid passage (not shown). The second fluid passage is in open fluid communication with an annular cavity 59, which is cooperatively defined by an inner annular surface of the valve housing 19 and the rotatable valve member 51.

The rotatable valve member 51 defines a plurality of alternating valve passages 61 and 63. The valve passages 61 are in continuous fluid communication with the annular fluid chamber 57 in the valve housing 19, while the valve passages 63 are in continuous fluid communication with the annular cavity 59. In the subject embodiment, and by way of example only, there are eight of the valve passages 61, and eight of the valve passages 63, corresponding to the eight external teeth or lobes on the star member 31.

Referring still to FIG. 1, a valve-seating mechanism, generally designated 65, is in sliding and sealing engagement with the rotatable valve member 51. The purpose of the valve-seating mechanism 65 is to maintain sealing engagement between a valve confronting surface 67 defined by the rotatable valve member 51 and a transverse valve surface 69 defined by the selector plate assembly 17. The valve-seating mechanism 65 illustrated in FIG. 1 has been described in detail in U.S. patent application Ser. No. 11/453,490 entitled "Bi-Directional Disc-Valve Motor and Improved Valve-Seating Mechanism Therefor," filed on Jun. 15, 2006, assigned to the assignee of the present invention and incorporated herein by reference. Therefore, further description of the valve-seating mechanism 65 will not be provided herein. It should be understood by those skilled in the art, however, that although the subject embodiment is described and shown with the improved valve-seating mechanism 65 disclosed in U.S. patent application Ser. No. 11/453,490, the present invention is not limited to rotary fluid pressure devices utilizing such valve-seating mechanisms.

Figure 3:
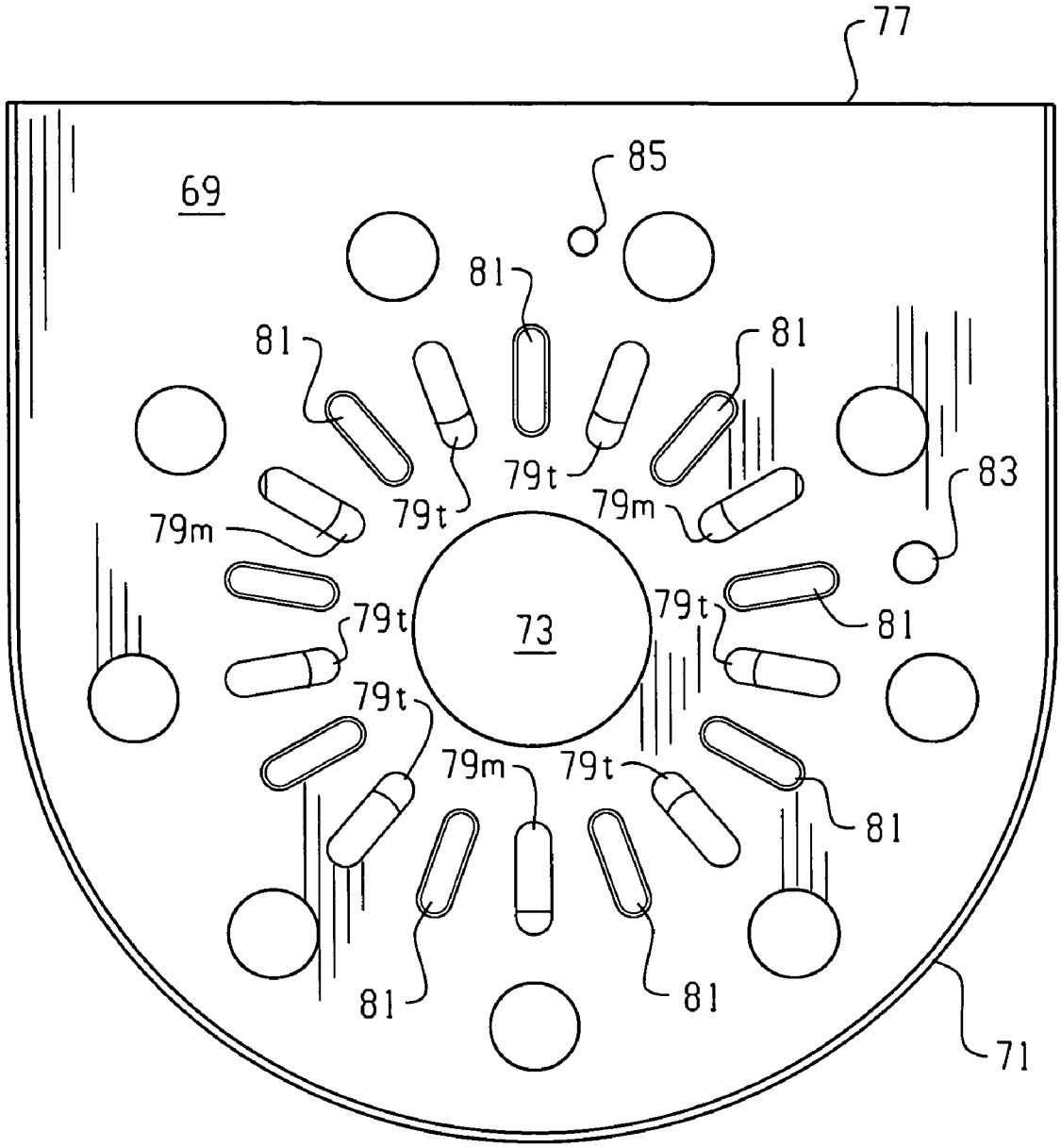
FIG. 3 is a transverse, plain view of the selector plate taken on line 3-3 of FIG. 1.

Referring now to FIGS. 1 and 3, the selector plate assembly 17 includes a selector plate 71 that defines a central opening 73, which extends axially through the selector plate 71. The selector plate 71 further defines several surfaces including the transverse valve surface 69, a transverse gerotor surface 75 (shown in FIGS. 1 and 4), and a manifold surface 77. The transverse valve surface 69 of the selector plate 71 defines a plurality of fluid passages, generally designated 79 (referred to in the appended claims as "upstream fluid passages"), which are in commutating fluid communication with the valve passages 61 and 63 in the rotatable valve member 51. The fluid passages 79 include a plurality of manifold passages 79*m* and a plurality of thru passages 79*t*. In the subject embodiment, and by way of example only, there are nine fluid passages 79, three of which are manifold passages 79*m* and six of which are thru passages 79*t*. The manifold passages 79*m* and the thru passages 79*t* will be described in greater detail subsequently. The transverse valve surface 69 further defines a plurality of fluid slots 81 which are alternately positioned on the transverse valve surface 69 with the fluid passages 79. As is well known to those skilled in the art, the fluid slots 81 are blind slots and function to maintain even contact between the transverse valve surface 69 and the valve confronting surface 67 of the rotatable valve member 51. While the fluid passages 79 and the fluid slots 81 have been shown in the subject embodiment as an integral feature of the selector plate 71, it will be understood by those skilled in the art that the present invention is not limited to such integration of the fluid passages 79 and the fluid slots 81 with the selector plate 71. The present invention would also include an embodiment in which a separate plate, which is in fluid communication with the selector plate 71, defines the fluid passages 79 and the fluid slots 81.

The transverse valve surface 69 further defines a case drain passage 83 and a pressurized fluid passage 85. The case drain passage 83 extends axially through the selector plate 71 and is in fluid communication with a case drain port 87 (shown only in FIG. 1) in the valve housing 19. The pressurized fluid passage 85 in the selector plate 71 is in open fluid communication with a fluid passage (not shown) in the valve housing 19. The fluid passage (not shown) in the valve housing 19 is in fluid communication with a shuttle valve arrangement (not shown) that allows fluid communication between the fluid passage (not shown) and either the first fluid port 53 or second fluid port (not shown), depending on which of those fluid ports in the valve housing 19 is supplied with high pressure fluid. Therefore, during operation, pressurized fluid from either the first fluid port 53 or the second fluid port (not shown) in the valve housing 19 is supplied to the pressurized fluid passage 85 in the selector plate 71. Since shuttle valve assemblies that function as previously described are well known to those skilled in the art, such an assembly will not been described herein.

Figure 4:
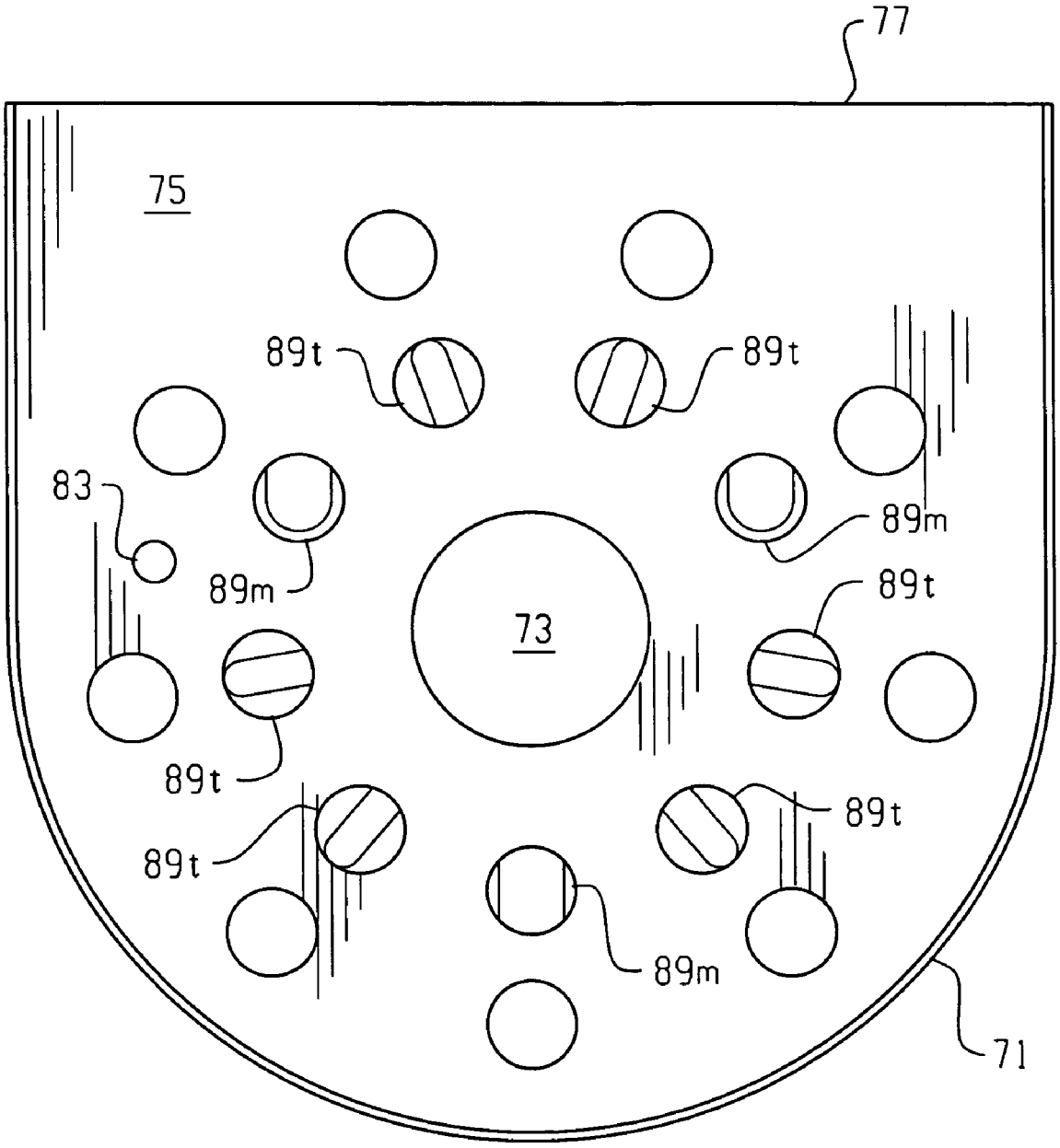
FIG. 4 is a transverse, plain view of the selector plate taken on line 4-4 of FIG. 1.

Referring now to FIG. 4, the transverse gerotor surface 75 of the selector plate 71 includes a plurality of fluid ports, generally designated 89 (referred to in the appended claims as "downstream fluid passages"). Each fluid port 89 is in open fluid communication with an adjacent volume chamber 33 in the gerotor displacement mechanism 15. The fluid ports 89 include a plurality of fluid manifold ports 89*m* and a plurality of fluid thru ports 89*t*. In the subject embodiment, and by way of example only, there are nine fluid ports 89, three of which are fluid manifold ports 89*m* and six of which are fluid thru ports 89*t*. The fluid thru ports 89*t* are in open and relatively unrestricted fluid communication with the thru passages 79*t*.

Figure 5:
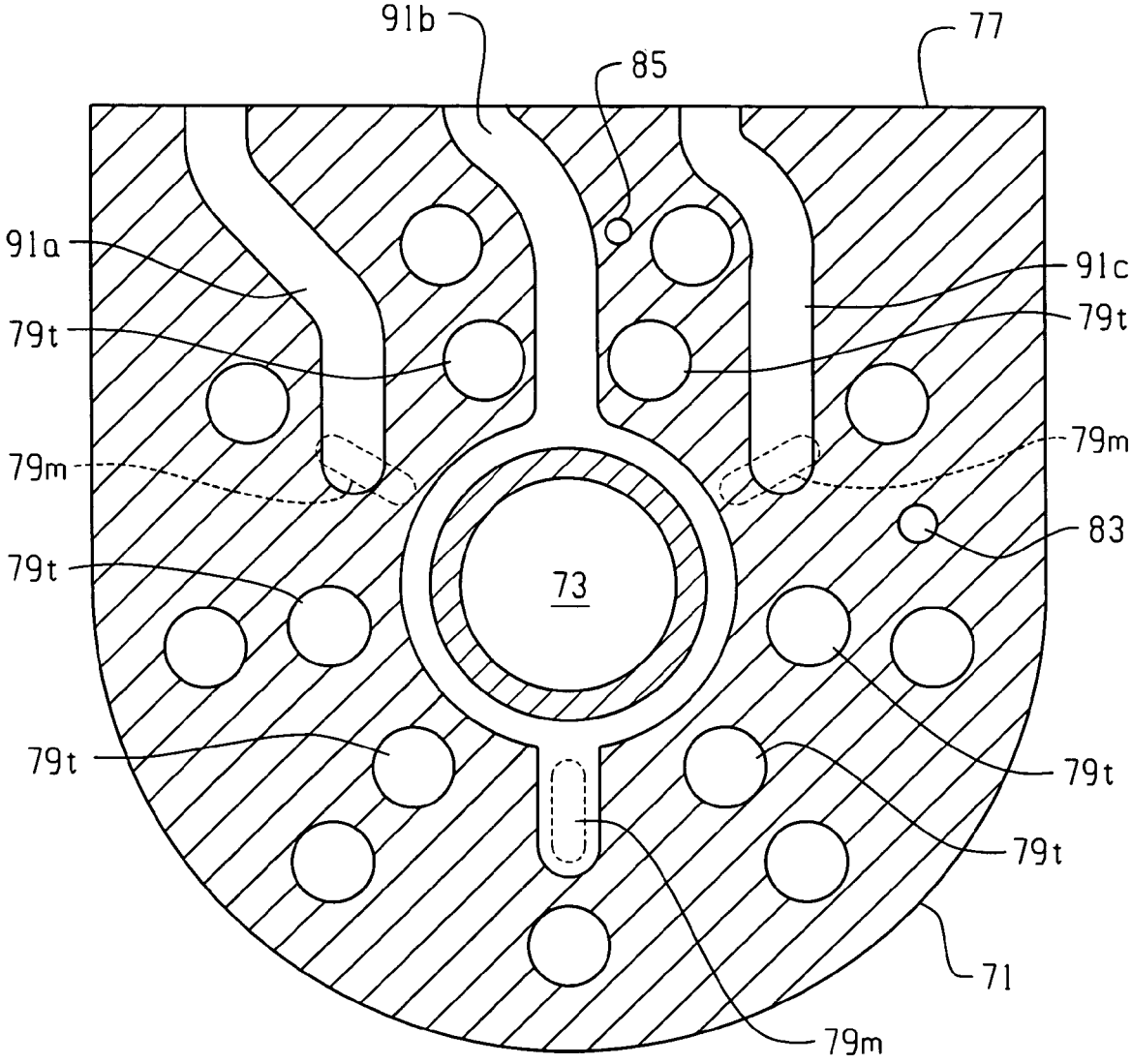
FIG. 5 is a transverse, cross-sectional view of the selector plate taken on line 5-5 of FIG. 1 with the manifold passages from FIG. 3 superimposed onto the view and shown as dashed lines.

Referring now to FIG. 5, a cross sectional view of the selector plate 71 is illustrated. For ease of description, the manifold passages 79*m* have been superimposed on to the cross-sectional view of the selector plate 71 and represented as dashed lines. Each manifold passage 79*m* is in open fluid communication with one of a plurality of fluid passages 91*a*, 91*b*, and 91*c* (referred to in the appended claims as "upstream manifold passages"). Each fluid passage 91*a*, 91*b*, and 91*c* extends from each manifold passage 79*m* to the manifold surface 77 of the selector plate 71.

Figure 6:
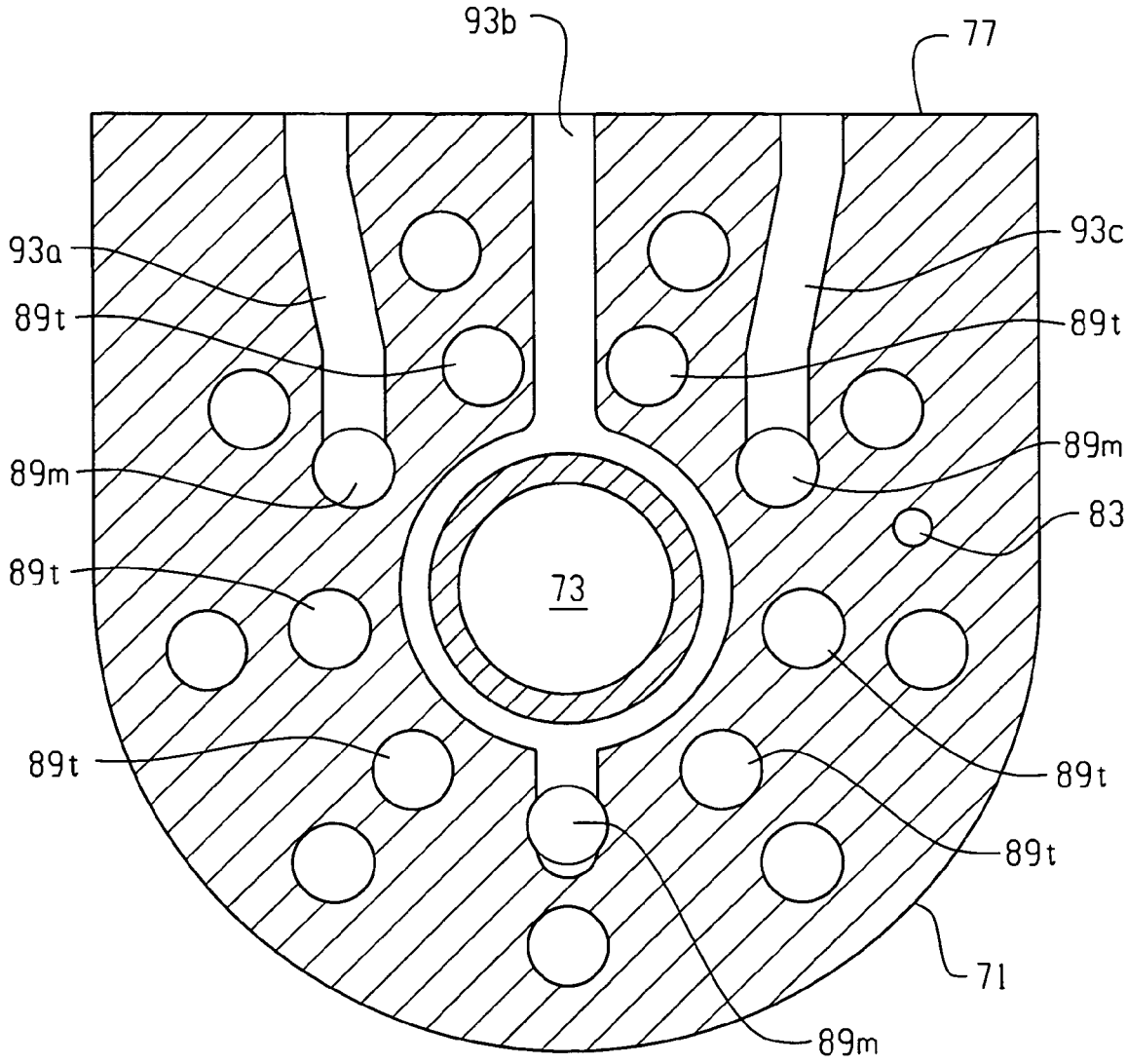
FIG. 6 is a transverse, cross-sectional view of the selector plate taken on line 6-6 of FIG. 1.

Referring now to FIG. 6, each fluid manifold port 89*m* is in open fluid communication with one of a plurality of fluid passages 93*a*, 93*b*, and 93*c* (referred to in the appended claims as "downstream manifold passages"). Each fluid passage 93*a*, 93*b*, and 93*c* extends from the corresponding fluid manifold port 89*m* to the manifold surface 77 of the selector plate 71.

Figure 7:
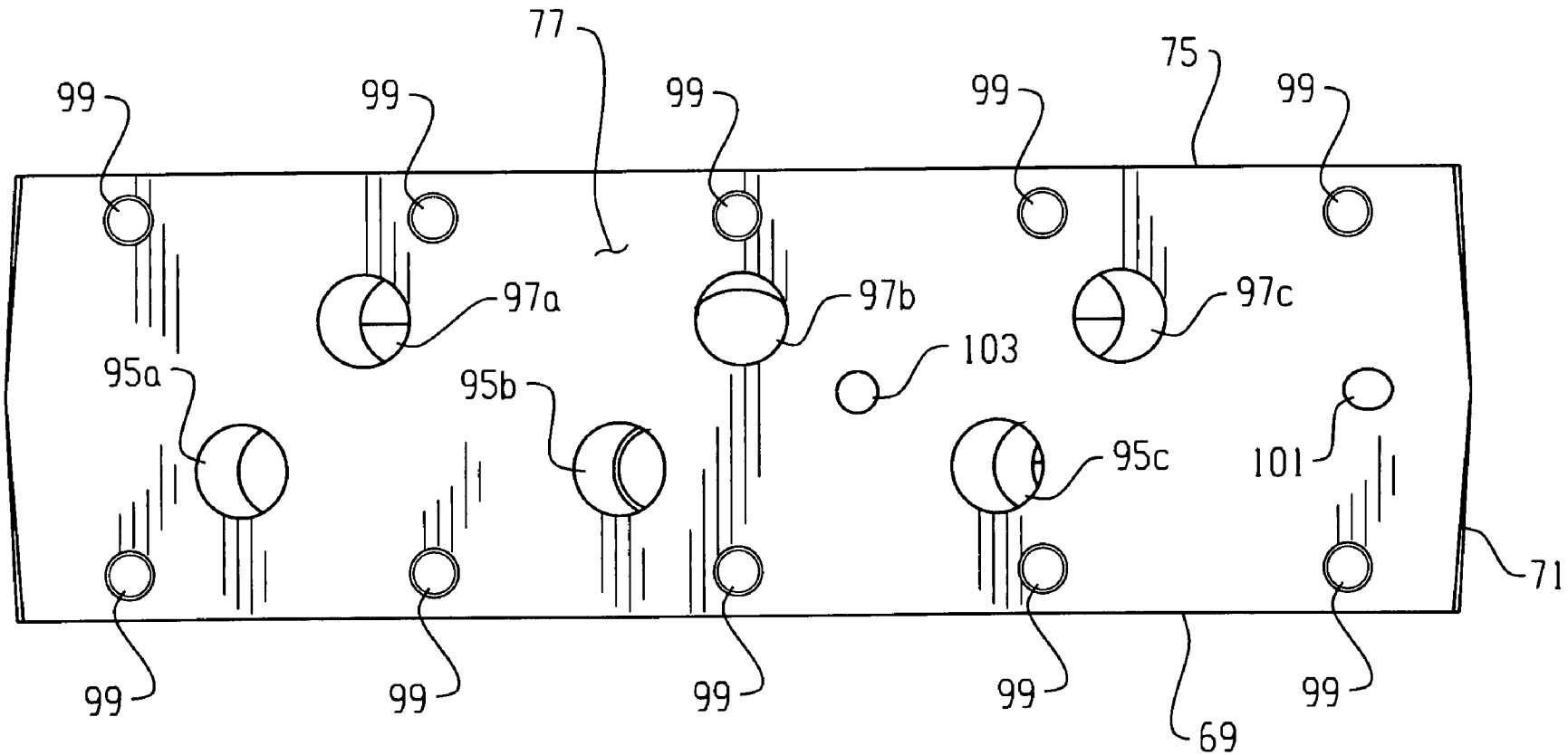
FIG. 7 is transverse, plain view of the manifold surface of the selector plate taken on line 7-7 of FIG. 1.

Referring now to FIG. 7, the manifold surface 77 of the selector plate 71 is shown. The manifold surface 77 defines a plurality of fluid passage openings 95*a*, 95*b*, and 95*c*, with each fluid passage opening 95*a*, 95*b*, and 95*c* being in open fluid communication with one of the plurality of fluid passages 91*a*, 91*b*, and 91*c* (shown in FIG. 5), respectively. The manifold surface 77 further defines a plurality of fluid passage openings 97*a*, 97*b*, and 97*c*, with each fluid passage opening 97*a*, 97*b*, and 97*c* being in open fluid communication with one of the plurality of fluid passages 93*a*, 93*b*, and 93*c* (shown in FIG. 6). Also defined by the manifold surface 77 are a plurality of threaded mounting holes 99. The manifold surface 77 also defines a drain passage 101 and a fluid passage 103. The drain passage 101 and the fluid passage 103 in the manifold surface 77 are in open fluid communication with the case drain passage 83 and the pressurized fluid passage 85, respectively.

Figure 8:
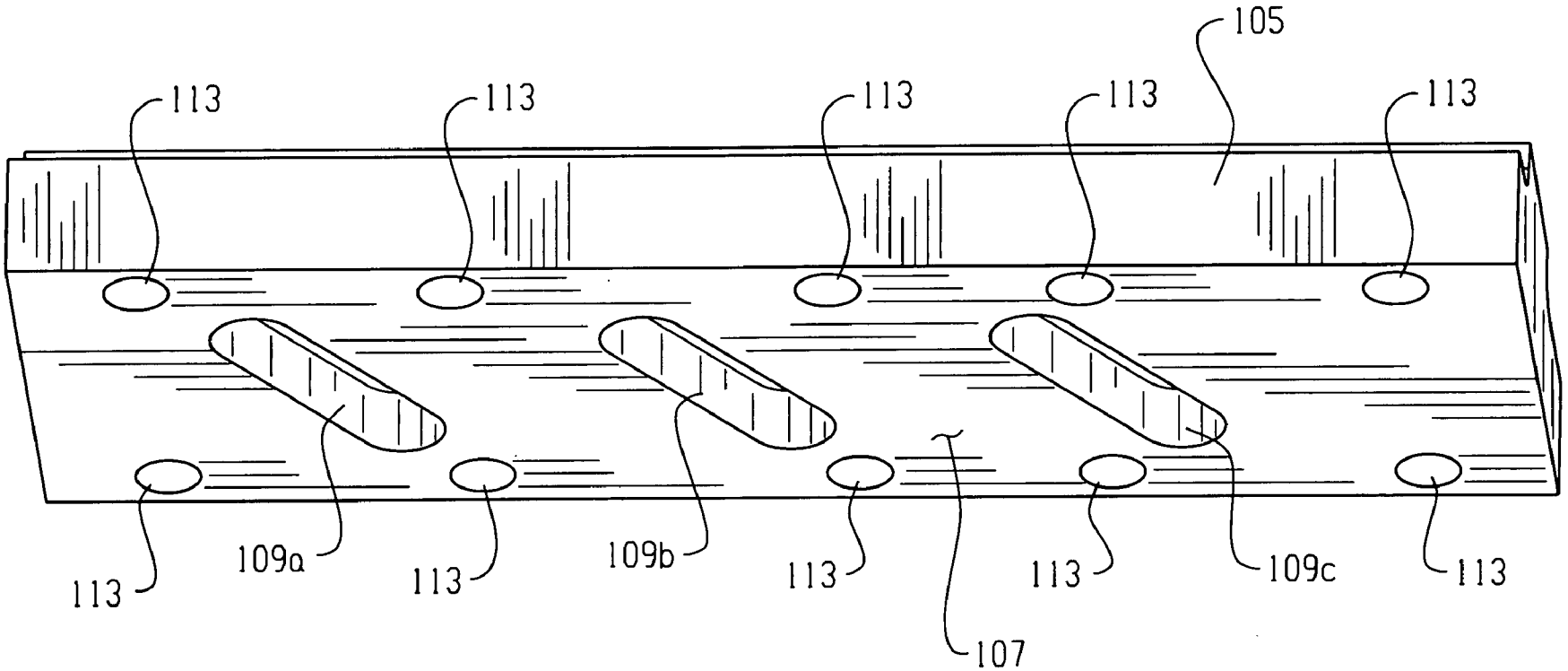
FIG. 8 is an orthogonal view of the cover plate showing primarily the mounting surface of the cover plate.

Referring now to FIGS. 1, 7 and 8, a cover plate 105 is used when only single-speed functionality of the disc valve motor 11 is required. The cover plate 105 defines a mounting surface 107, disposed in which are a plurality of fluid grooves 109*a*, 109*b*, and 109*c*. The cover plate 105 is held in tight sealing engagement with the selector plate 71 by a plurality of bolts 111 (shown only in FIG. 1) that pass through a plurality of holes 113 in the cover plate 105 and thread into the mounting holes 99 in the mounting surface 77 in the selector plate 71. With the mounting surface 107 of the cover plate 105 in tight sealing engagement with the manifold surface 77 of the selector plate 71, the fluid grooves 109*a*, 109*b*, and 109*c* provide open fluid communication between the fluid passage openings 95*a*, 95*b*, and 95*c* and the fluid passage openings 97*a*, 97*b*, and 97*c*, respectively. It should be understood by those skilled in the art that although the cover plate 105 has been described and illustrated as a single plate, the present invention is not limited to such a configuration. It should be understood by those skilled in the art that the cover plate 105 could include a plurality of separate plates which provide fluid communication between the fluid passage openings 95*a*, 95*b*, and 95*c* and the fluid passage openings 97*a*, 97*b*, and 97*c*, in the manifold surface 77 of the selector plate 71.

Referring now to FIGS. 1 through 8, in operation, pressurized fluid entering the first fluid port 53 will flow through the fluid passage 55 and into the annular fluid chamber 57. The pressurized fluid will then flow into the valve passages 61 in the rotatable valve member 51, which are in commutating fluid communication with the fluid passages 79 in the selector plate 71. Pressurized fluid that enters the fluid passages 79*t* in the selector plate 71 is openly communicated to the fluid thru ports 89*t* in the selector plate 71 and to the adjacent expanding volume chambers 33 in the gerotor displacement mechanism 15. Pressurized fluid that enters the fluid passages 79*m* in the selector plate 71 flows through the corresponding fluid passages 91*a*, 91*b*, and 91*c* and into the fluid passage openings 95*a*, 95*b*, and 95*c*, respectively, in the manifold surface 77 of the selector plate 71. The pressurized fluid then flows from the fluid passage openings 95*a*, 95*b*, and 95*c* through the fluid grooves 109*a*, 109*b*, and 109*c* in the mounting surface 107 of the cover plate 105 and into the fluid passage openings 97*a*, 97*b*, and 97*c*, respectively, in the manifold surface 77 of the selector plate 71. The pressurized fluid is then communicated to the fluid passages 93*a*, 93*b*, and 93*c* and to the corresponding fluid manifold ports 89*m*, from where the pressurized fluid enters the adjacent expanding volume chamber 33 in the gerotor displacement mechanism 15. Exhaust fluid from the contracting volume chambers 33 in the gerotor displacement mechanism 15 follows the reverse of the path previously described through the selector plate 71 to the valve passages 63 in the rotatable valve member 51 and to the second fluid port (not shown) in the valve housing 19.

Figure 9:
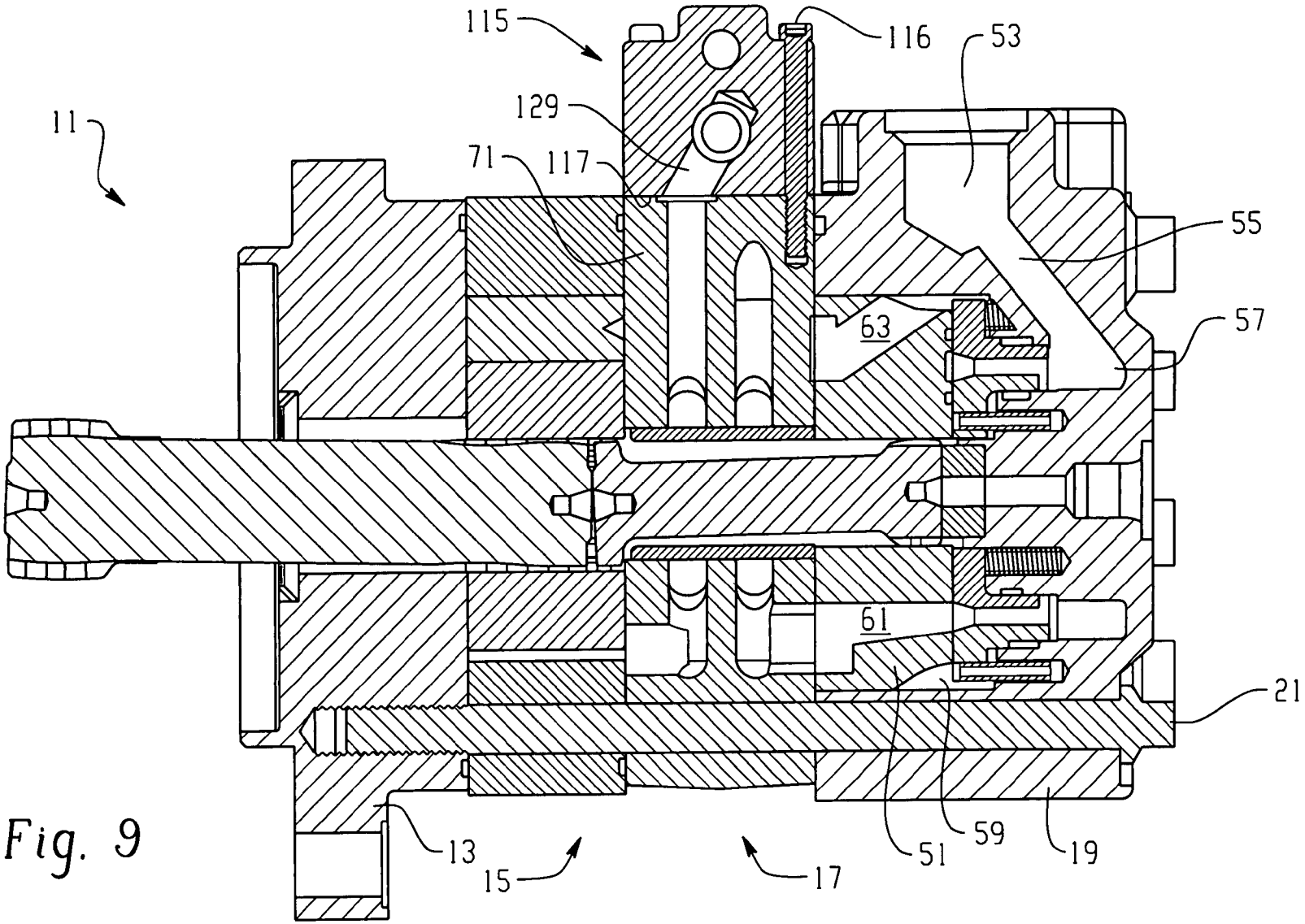
FIG. 9 is an axial cross-sectional view of a two-speed rotary fluid pressure device.

As previously mentioned, the cover plate 105 is used when only single speed functionality of the disc valve motor 11 is required. However, in the event that a manufacturer of commercial applications requires multi-speed functionality instead of single-speed functionality from the disc valve motor 11, the conversion can be accomplished by replacing the cover plate 105 with a control valve assembly, generally designated 115 (shown in FIG. 9), which will be described in greater detail subsequently. Referring now to FIGS. 1, 8 and 9, conversion from a single-speed disc valve motor 11 to a multi-speed disc valve motor 11 requires removal of the plurality of bolts 111, which maintain the tight sealing engagement between the mounting surface 107 of the cover plate 105 and the manifold surface 77 of the selector plate 71, and removal of the cover plate 105 from the manifold surface 77 of the selector plate 71. With the cover plate 105 removed, the control valve assembly 115 is mounted to the manifold surface 77 of the selector plate 71. A plurality of bolts 116 (shown only in FIG. 9) maintain tight sealing engagement between the manifold surface 77 of the selector plate 71 and a mounting surface 117 of the control valve assembly 115.

Figure 10:
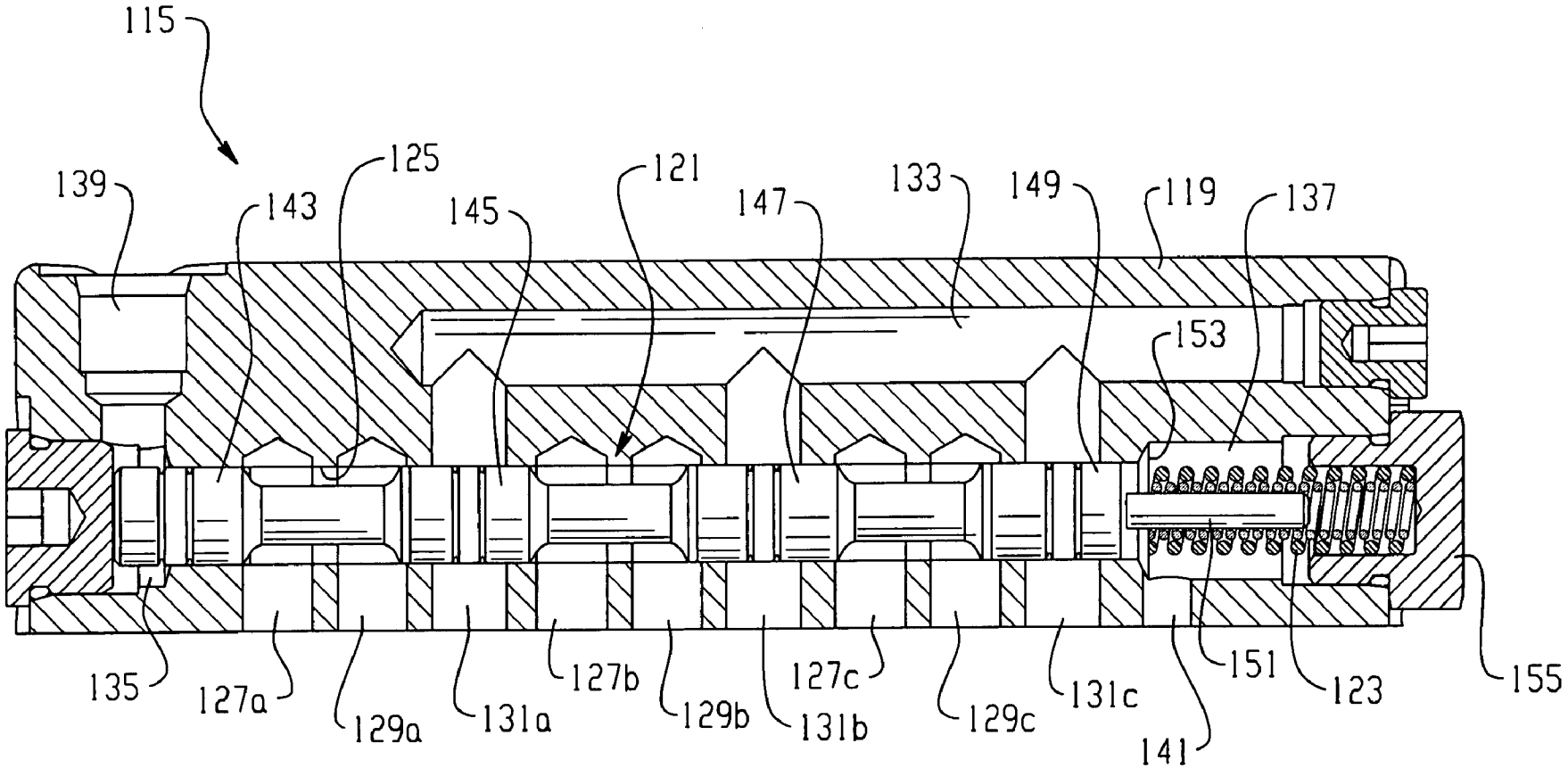
FIG. 10 is an axial cross-sectional view of the control valve assembly taken on line 10-10 of FIG. 9 showing the control valve spool in the lo-speed mode position.

Referring now to FIGS. 9 and 10, the control spool assembly 115 will now be described. In the present embodiment, and by way of example only, the control spool assembly 115 provides two modes of operation, lo-speed mode and hi-speed mode. FIG. 10 illustrates the control spool assembly 115 in the lo-speed mode.

Referring now primarily to FIG. 10, the control spool assembly 115 includes a spool block 119, a control valve spool 121, and a spring member 123. The spool block 119 defines a spool bore 125, disposed in which is the control valve spool 121. The spool block 119 further defines a plurality of valve control passages 127*a*, 127*b*, and 127*c*, a plurality of gerotor control passages 129*a*, 129*b*, and 129*c*, and a plurality of high-pressure passages 131*a*, 131*b*, and 131*c* that are in fluid communication with the spool bore 125. For ease of illustration, the valve control passages 127, the gerotor control passages 129, and the high-pressure passages 131 have been shown in FIGS. 10 and 11 to be planar. However, it should be understood by those skilled in the art that the valve control passages 127, the gerotor control passages 129, and the high-pressure passages 131 are disposed on different planes in the spool block 119. The planes corresponding the valve control passages 127 and the gerotor control passages 129 are defined by the location of the fluid passage openings 95 and the fluid passage openings 97, respectively, in the manifold surface 77 of the selector plate 71 and the spool bore 125 in the spool block 119. The orientation of the gerotor control passages 129 is illustrated in FIG. 9. However, it should be understood by those skilled in the art that the present invention is not limited to the valve control passages 127, the gerotor control passages 129, and the high-pressure passages 131 being nonplanar.

Also defined by the spool block 119 is a pressure passage 133 which is in fluid communication with each of the high-pressure passages 131*a*, 131*b*, and 131*c*. While it has been shown in FIG. 10 that the high-pressure passages 131*a*, 131*b*, and 131*c* are interconnected by the pressure passage 133, it will be understood by those skilled in the art that the subject embodiment is not limited to the presence of such a passage in the spool block 119 since pressurized fluid could be provided to each high-pressure passage 131*a*, 131*b*, and 131*c* individually. The spool bore 125 includes a first axial end 135 and a second axial end 137. The first axial end 135 is in fluid communication with a pilot pressure port 139, and the second axial end 137 is in fluid communication with the drain passage 101 in the manifold surface 77 through a fluid passage 141.

Referring still primarily to FIG. 10, the control valve spool 121 defines a plurality of lands 143, 145, 147, and 149 and a protrusion 151 that extends from an axial end 153 of the control valve spool 121. The axial end 153 of the control valve spool 121 and a plug member 155, which is in threaded engagement with the second axial end 137 of the spool bore 125, serve as seats for the spring member 123, which biases the control valve spool 121 toward the left in FIG. 10, i.e. toward the lo-speed mode of operation.

Since the operation of a control valve spool that is similar to the control valve spool 121 of the present embodiment has been described in great detail in U.S. Pat. No. 6,099,280, assigned to the assignee of the present invention and incorporated herein by reference, the operation of the control valve spool 121 will be only briefly described herein. Those skilled in the art, however, will understand that the details of the operation of the control valve spool 121 are not essential features of the present invention, except to the extent so indicated hereinafter, and in the appended claims.

In the lo-speed mode of operation, the spring member 123 biases the control valve spool 121 toward the left in FIG. 10. In this position, the control valve spool 121 allows open fluid communication between the plurality of valve control passages 127*a*, 127*b*, and 127*c*, and the gerotor control passages 129*a*, 129*b*, and 129*c*, respectively, while the lands 145, 147 and 149 of the control valve spool 121 block the high-pressure passages 131*a*, 131*b*, and 131*c*, respectively.

Referring now to FIGS. 2 through 7, 9 and 10, in operation, pressurized fluid entering the first fluid port 53 will flow through the fluid passage 55 and into the annular fluid chamber 57. The pressurized fluid will then flow into the valve passages 61 in the rotatable valve member 51, which are in commutating fluid communication with the fluid passages 79 in the selector plate 71. Pressurized fluid that enters the fluid passages 79*t* in the selector plate 71 is openly communicated to the corresponding fluid thru ports 89*t* in the selector plate 71 and to the adjacent expanding volume chambers 33 in the gerotor displacement mechanism 15. Pressurized fluid that enters the fluid passages 79*m* in the selector plate 71 flows through the respective fluid passages 91*a*, 91*b*, and 91*c* in the selector plate 71, through the respective fluid passage openings 95*a*, 95*b*, and 95*c* in the manifold surface 77 of the selector plate 71, and into the respective valve control passages 127*a*, 127*b*, and 127*c*. As stated previously, with the control valve spool 121 biased toward the lo-speed mode of operation, the valve control passages 127*a*, 127*b*, and 127*c* and the gerotor control passages 129*a*, 129*b*, and 129*c* are in open fluid communication. Therefore, pressurized fluid in the valve control passages 127*a*, 127*b*, and 127*c* is communicated to the respective gerotor control passages 129*a*, 129*b*, and 129*c* and through the respective fluid passage openings 97*a*, 97*b*, and 97*c* in the manifold surface 77 of the selector plate 71. The pressurized fluid is then communicated to the respective fluid passages 93*a*, 93*b*, and 93*c* and to the respective fluid manifold ports 89*m*, from where it enters the corresponding adjacent expanding volume chamber 33 in the gerotor displacement mechanism 15. Fluid from the contracting volume chambers 33 in the gerotor displacement mechanism 15 follows a reverse path similar to the one previously described through the selector plate 71 to the valve passage 63 in the rotatable valve member 51 and to the second fluid port (not shown) in the valve housing 19.

Figure 11:
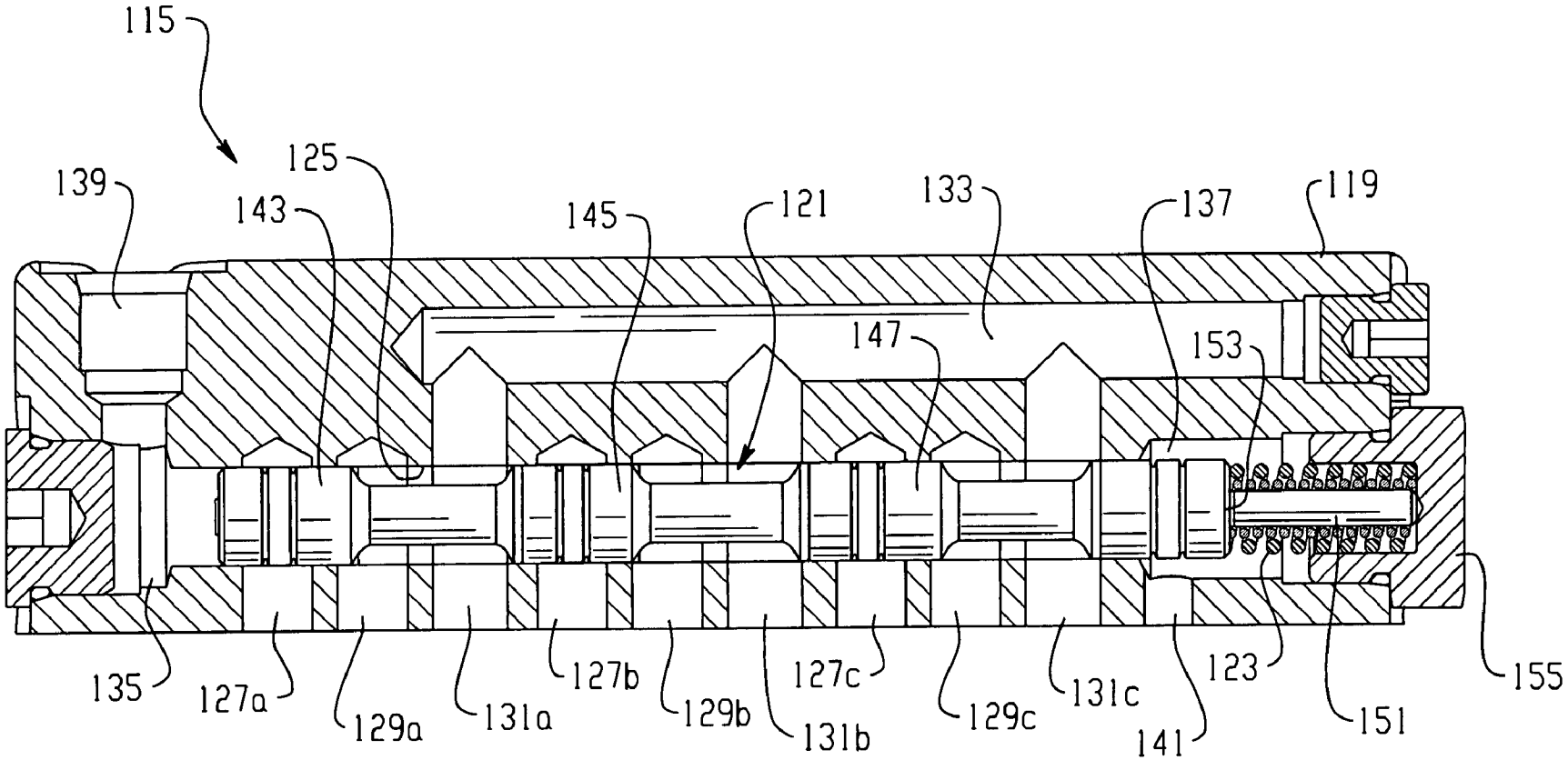
FIG. 11 is an axial cross-sectional view of the control valve assembly similar to FIG. 10, except that the control valve spool is shown in the hi-speed mode position.

Referring now to FIG. 11, the control spool assembly 115 is shown in the hi-speed mode of operation. In this mode of operation, the control valve spool 121 is biased toward the right in FIG. 11 by pilot pressure supplied to the pilot pressure port 139, thereby resulting in the compression of the spring member 123. By way of example only, in a closed loop propel system, the pressure from a charge pump (typically 200 to 400 psi) could serve as the pilot pressure. The protrusion 151, which extends from the axial end 153 of the control valve spool 121, is operably associated with the plug member 155 such that the plug member 155 provides a positive stop for the protrusion 151 of the control valve spool 121 after the control valve spool 121 has translated a given axial distance. In order to prevent the trapping of fluid in the second axial end 137 of the spool bore 125, any fluid that leaks into the second axial end 137 of the spool bore 125 flows into the drain passage 141 in the spool block, through the drain passage 101 in the manifold surface 77, and into the case drain passage 83 in the selector plate 71 where the fluid is communicated to the case drain fluid port 87 in the valve housing 19.

With the control valve spool 121 in the hi-speed mode position, the lands 143, 145, and 147 of the control valve spool 121 block the valve control passages 127*a*, 127*b*, and 127*c*. Pressurized fluid from the pressurized fluid passage 85 in the selector plate 71 flows through the fluid passage 103 in the manifold surface 77 and into the high-pressure passage 131*b* where the pressurized fluid is communicated to the other high-pressure passages 131*a* and 131*c* through the pressure passage 133 in the spool block 119. With the control valve spool 121 blocking the valve control passages 127*a*, 127*b*, and 127*c*, the high-pressure passages 131*a*, 131*b*, and 131*c* are now in open fluid communication with the respective gerotor control passages 129*a*, 129*b*, and 129*c*.

Referring now to FIGS. 2 through 7, 9, and 11, in operation, pressurized fluid entering the first fluid port 53 will flow through the fluid passage 55 and into the annular fluid chamber 57. The pressurized fluid will then flow into the valve passages 61 in the rotatable valve member 51, which are in commutating fluid communication with the fluid passages 79 in the selector plate 71. Pressurized fluid that enters the fluid passages 79*t* in the selector plate 71 is openly communicated to the fluid thru ports 89*t* in the selector plate 71 and to the expanding volume chambers 33 in the gerotor displacement mechanism 15. Pressurized fluid that enters the fluid passages 79*m* in the selector plate 71 flows through the respective fluid passages 91*a*, 91*b*, and 91*c* in the selector plate 71 and through the respective fluid passage openings 95*a*, 95*b*, and 95*c* in the manifold surface 77 of the selector plate 71 and into the respective valve control passages 127*a*, 127*b*, and 127*c*. As stated previously, with the control valve spool 121 biased toward the hi-speed mode of operation, the valve control passages 127*a*, 127*b*, and 127*c* are blocked. Pressurized fluid from the pressurized fluid passage 85 in the selector plate 71 flows through the fluid passage 103 in the manifold surface 77 and into the high-pressure passage 131*b* where the pressurized fluid is communicated to the other high-pressure passages 131*a* and 131*c* through the pressure passage 133 in the spool block 119. The high-pressure passages 131*a*, 131*b*, and 131*c* are in open fluid communication with the respective gerotor control passages 129*a*, 129*b*, and 129*c*. This pressurized fluid from the pressurized fluid passage 85 then flows through the respective fluid passage openings 97*a*, 97*b*, and 97*c* in the manifold surface 77 of the selector plate 71 to the respective fluid passages 93*a*, 93*b*, and 93*c*. The pressurized fluid from the pressurized fluid passage 85 in the selector plate 71 then flows to the respective fluid manifold ports 89*m*, from where it enters the adjacent volume chambers 33 in the gerotor displacement mechanism 15, regardless of whether the volume chamber 33 is expanding or contracting. As is well known to those skilled in the art, by supplying pressurized fluid to a contracting volume chamber 33, the effective displacement of the gerotor displacement mechanism 15 is reduced which results in a higher speed for a given flow rate of fluid.

Fluid from contracting volume chambers which are adjacent to the fluid thru ports 89*t* flows through the selector plate 71 to the thru passages 79*t*. The fluid then flows through the valve passages 63 in the rotatable valve member 51 and to the second fluid port (not shown) in the valve housing.

Figure 12:
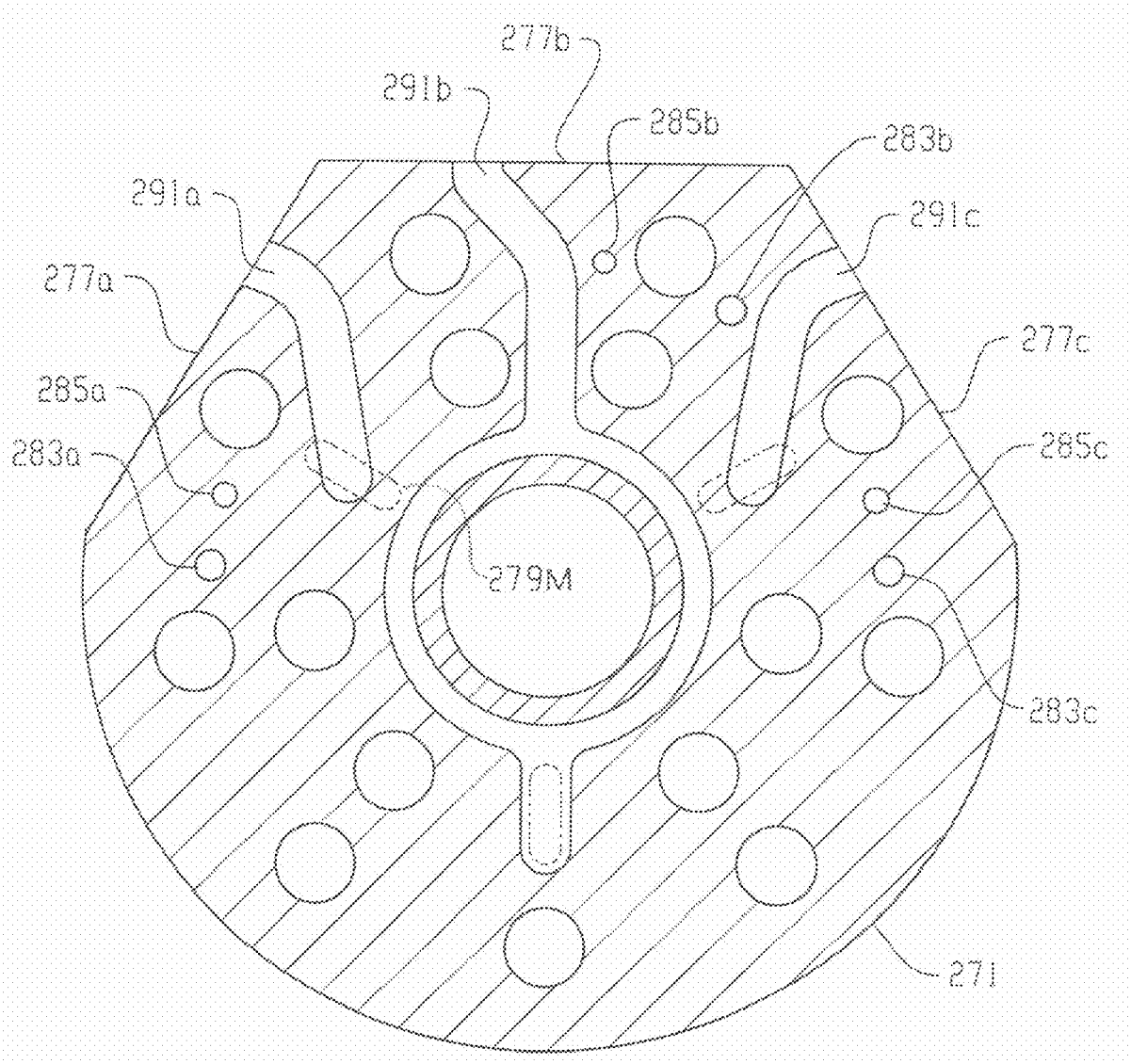
FIG. 12 is a transverse, cross-sectional view of an alternative embodiment of the selector plate, similar to FIG. 5, taken on line 12-12 of FIG. 1.

Referring now primarily to FIG. 12, which is similar to FIG. 4, there is illustrated an alternative embodiment of a selector plate 271 in which the same or similar elements bear the same reference numerals, plus "200". The primary distinction between this embodiment of the selector plate 271 and the previously described embodiment of the selector plate 71 is that this alternative embodiment of the selector plate 271 defines a plurality of manifold surfaces 277*a*, 277*b*, 277*c*. As a result of the plurality of manifold surfaces 277*a*, 277*b*, 277*c*, the selector plate 271 further defines a plurality of case drain passages 283*a*, 283*b*, 283*c*, which are in fluid communication with the case drain port 87 (shown only in FIG. 1) in the valve housing 19, and a plurality of pressurized fluid passages 285*a*, 285*b*, 285*c*, which are in fluid communication with the first fluid port 53 and the second fluid port (not shown) via the shuttle valve arrangement (not shown). Each of a plurality of manifold passages 279*m*, which have been superimposed onto FIG. 12 and represented as dashed lines for ease of description, is in fluid communication with one of a plurality of fluid passages 291*a*, 291*b*, 291*c*. Each fluid passage 291*a*, 291*b*, 291*c* extends from one of the manifold passages 279*m* to one of the manifold surfaces 277*a*, 277*b*, 277*c*, respectively.

Figure 13:
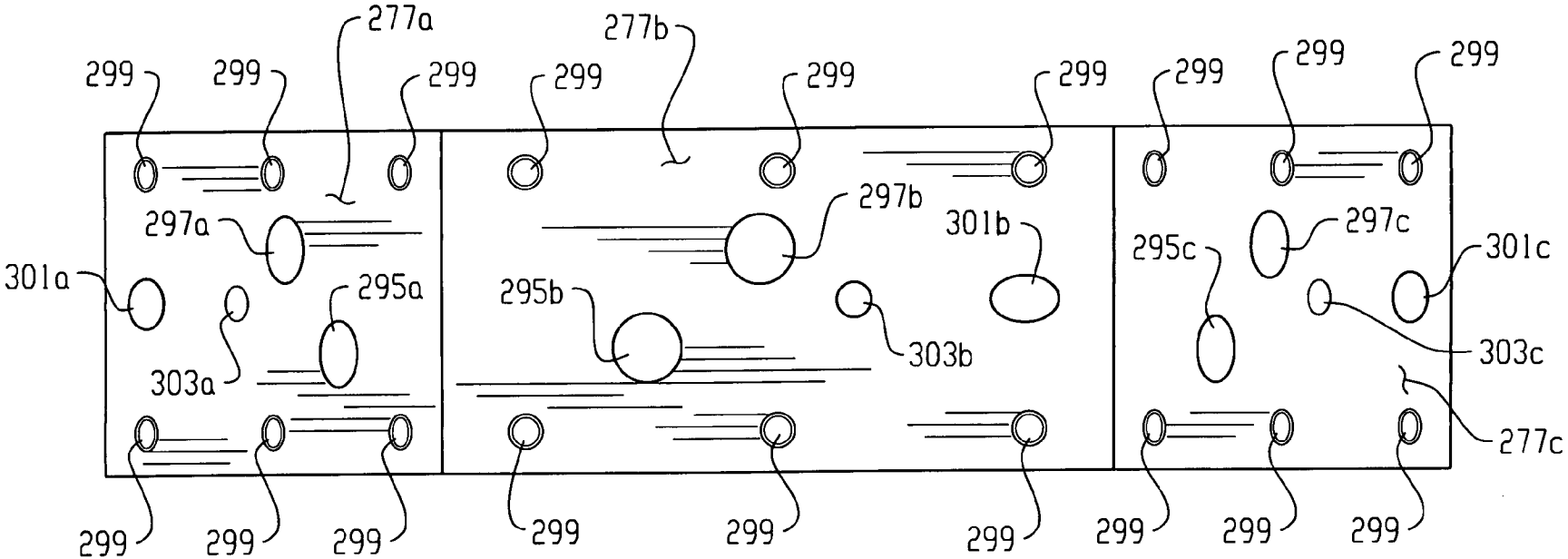
FIG. 13 is a transverse, plain view of the manifold surface of the alternative embodiment of the selector plate, similar to FIG. 7, taken on line 13-13 of FIG. 1.

Referring now to FIG. 13, the manifold surfaces 277*a*, 277*b*, 277*c* of the selector plate 271 are shown. Each manifold surface 277*a*, 277*b*, 277*c* defines one of a plurality of fluid passage openings 295*a*, 295*b*, 295*c*, each of which is in fluid communication with one of the upstream manifold passages 291*a*, 291*b*, 291*c*, respectively, and one of a plurality of fluid passage openings 297*a*, 297*b*, 297*c*, each of which is in fluid communication with one of the downstream manifold passages respectively. Also defined by the manifold surfaces 277*a*, 277*b*, 277*c* are a plurality of treaded mounting holes 299. Each manifold surface 277*a*, 277*b*, 277*c* further defines one of a plurality of drain passages 301*a*, 301*b*, 301*c*, and one of a plurality of fluid passages 303*a*, 303*b*, 303*c* which are in open fluid communication with the case drain passages 283*a*, 283*b*, 283*c* and the pressurized fluid passages 285*a*, 285*b*, 285*c*, respectively.

Figure 14:
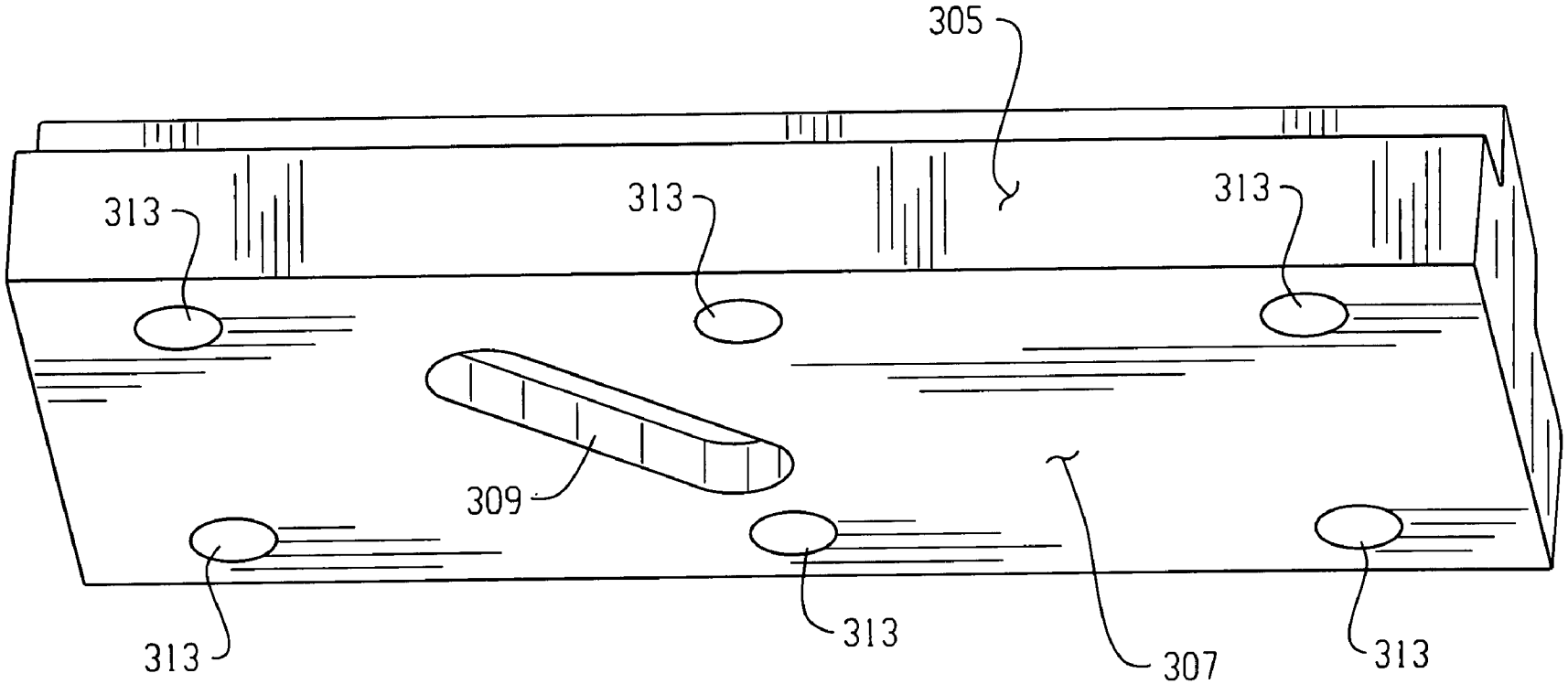
FIG. 14 is an orthogonal view of an alternative embodiment of the cover plate showing primarily the mounting surface of the cover plate.

Referring now to FIG. 14, there is illustrated an alternative embodiment of a cover plate 305. The cover plate 305 defines a mounting surface 307, disposed in which is a fluid groove 309. The cover plate 305 further defines a plurality of holes 313 through which a plurality of bolts (not shown but similar to those referred to in FIG. 1 by reference numeral 111), which are in threaded engagement with the mounting holes 299 in the manifold surfaces 277*a*, 277*b*, 277*c*, pass. With the cover plate 305 in tight sealing engagement with the mounting surface 277*b* of the selector plate 271, the fluid groove 309 provides open fluid communication between the fluid passage opening 295*b* and the fluid passage opening 297*b*. Similarly, with cover plates 305 in tight sealing engagement with the mounting surface 277*a* and 277*c*, the fluid grooves 309 will provide open fluid communication between fluid passage openings 295*a* and 295*c* and fluid passage openings 297*a* and 297*c*, respectively.

Figure 15:
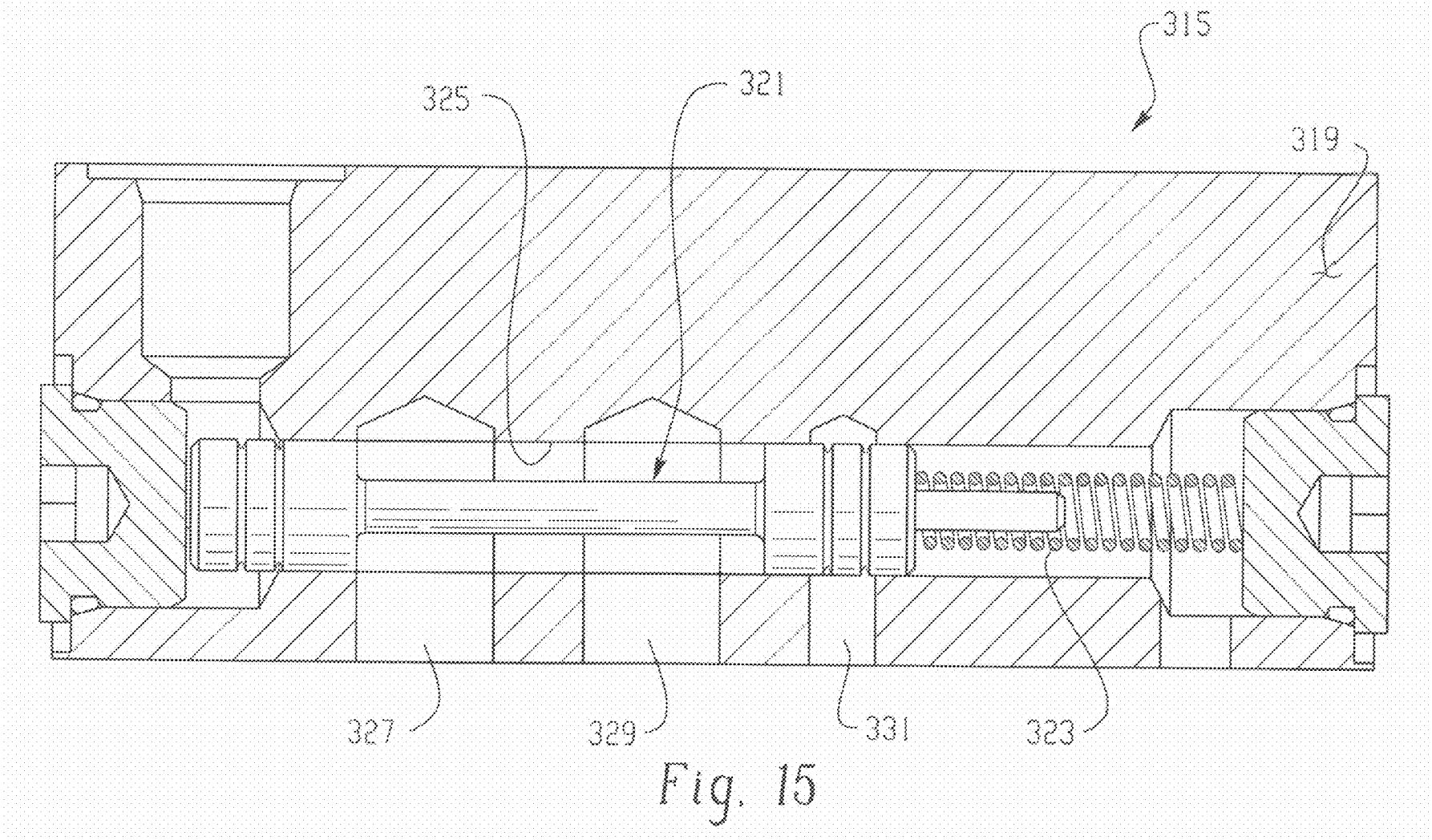
FIG. 15 is an axial cross-sectional view of an alternative embodiment of the control spool assembly similar to FIG. 10, showing the control valve spool in the lo-speed mode position.

Referring now to FIG. 15, an alternative embodiment is illustrated of a control spool assembly 315 in lo-speed mode. The control spool assembly 315 includes a spool block 319, a control valve spool 321, and a spring member 323. The spool block 319 defines a spool bore 325, disposed in which is the control valve spool 321. The spool block 319 further defines a valve control passage 327, a gerotor control passage 329, and a high-pressure passage 331 that are in fluid communication with the spool bore 325. Similar to FIG. 10, the valve control passage 327, the gerotor control passage 329, and the high-pressure passage 331 have been shown to be planar for ease of illustration. As the operation of the control spool assembly 315 is similar to the operation of the control spool assembly 115 previously described, no description of the operation of the control spool assembly 315 will be provided herein.

In the alternative embodiment, when only single speed functionality of the disc valve motor 11 is required, the plurality of cover plates 305 are mounted in tight sealing engagement with the plurality of mounting surfaces 277*a*, 277*b*, 277*c*. However, in the event that a manufacturer of commercial applications requires multi-speed functionality instead of single-speed functionality from the disc valve motor 11, the conversion can be accomplished by replacing at least one of the plurality of cover plates 305 with a control valve assembly 315. The number of cover plates 305 replaced with control valve assemblies 315 only affects the speed ratio between lo-speed mode and hi-speed mode of the disc valve motor 11. Conversion from a single-speed disc valve motor 11 to a multi-speed disc valve motor 11 requires removal of the plurality of bolts (not shown), which maintain the tight sealing engagement between the mounting surface 307 of at least one of the plurality of cover plates 305 and at least one of the manifold surfaces 277*a*, 277*b*, 277*c* of the selector plate 271, and removal of at least one of the cover plates 305 from at least one of the manifold surfaces 277*a*, 277*b*, 277*c* of the selector plate 271. A control valve assembly 315 is mounted to the manifold surface 277*a*, 277*b*, 277*c* of the selector plate 271 from which the cover plate 305 was removed. A plurality of bolts (not shown but similar to those referred to in FIG. 9 by reference numeral 116) maintain tight sealing engagement between the manifold surface 277*a*, 277*b*, 277*c* of the selector plate 271 and a mounting surface 317 of the control valve assembly 315.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device of the type having a housing means defining a fluid inlet and a fluid outlet, a fluid energy-translating displacement means including a first member and a second member, operably associated with said first member; said first member and said second member having relative movement, and interengaging to define a plurality N of expanding and contracting fluid volume chambers in response to said relative movement; a valve member providing fluid communication between said fluid inlet and said expanding volume chambers, and between said fluid outlet and said contracting volume chambers; a plate member defining a plurality N of upstream fluid passages in commutating fluid communication with said valve member and a plurality N of downstream fluid passages, with each said downstream fluid passage being in open fluid communication with one of said plurality of volume chambers; a plurality M of upstream fluid passages being in direct, relatively unrestricted, continuous fluid communication with a plurality M of downstream fluid passages; characterized by:

(a) a plate assembly including said plate member and at least one assembly selected from the group consisting of a cover plate assembly and a control valve assembly;

(b) said plate member including a plurality M of upstream manifold passages, with each of said plurality of upstream manifold passages being in open fluid communication with one of a plurality M of upstream fluid passages and having an opening in an exterior surface of said plate member, and a plurality M of downstream manifold passages, with each of said plurality of downstream manifold passages being in fluid communication with one of a plurality M of downstream fluid passages and having an opening in said exterior surface of said plate member; wherein:

(i) said cover plate assembly defining a mounting surface being in sealing engagement with said exterior surface of said plate member with said cover plate assembly providing unrestricted fluid communication between at least one of said plurality of upstream manifold passages and at least one of said plurality of downstream manifold passages in said plate member; and (ii) said control valve assembly defining a mounting surface being in sealing engagement with said exterior surface of said plate member with said control valve assembly being operable in a first position to provide relatively unrestricted fluid communication between at least one of said plurality of upstream manifold passages and at least one of said plurality of downstream manifold passages in said plate member, and operable in a second position to block fluid communication between at least one of said plurality of upstream manifold passages and at least one of said plurality of downstream manifold passages in said plate member.

2. A rotary fluid pressure device as claimed in claim 1, characterized by said fluid displacement means being of the gerotor type.

3. A rotary fluid pressure device as claimed in claim 2, characterized by said valve member being of the disc valve type.

4. A rotary fluid pressure device as claimed in claim 1, characterized by a transverse surface of said plate member being in direct commutating fluid communication with said valve member.

5. A rotary fluid pressure device as claimed in claim 1, characterized by said control valve assembly being operable in said second position to provide relatively unrestricted fluid communication between each of said plurality of downstream manifold passages.

6. A rotary fluid pressure device as claimed in claim 5, characterized by said control valve assembly defining a passage in fluid communication with a source of pressurized fluid.

7. A rotary fluid pressure device as claimed in claim 6, characterized by said passage in the control valve assembly being in fluid communication with a pressurized fluid passage in said plate member.

8. A method for converting a single-speed rotary fluid pressure device to a multi-speed rotary fluid pressure device wherein the rotary fluid pressure device is of the type comprising a housing means defining a fluid inlet and a fluid outlet, a fluid displacement means including a first member and a second member operably associated with said first member; said first member and said second member having relative movement, and interengaging to define a plurality of expanding and contracting fluid volume chambers in response to said relative movement, a valve member providing fluid communication between said fluid inlet and said expanding volume chambers; and a plate assembly including a plate member; said method being characterized by:

(a) removing at least one cover plate assembly from at least one exterior surface of said plate member, with said exterior surface defining at least one opening in fluid communication with at least one upstream manifold passage in said plate member and at least one opening in fluid communication with at least one downstream manifold passage in said plate member;

(b) providing at least one control valve assembly having a mounting surface; and (c) mounting said mounting surface of said control valve assembly to said exterior surface of said plate member, with the control valve being operable in a first position to provide relatively unrestricted fluid communication between at least one of said upstream manifold passages and at least one of said downstream manifold passages in said plate member, and operable in a second position to block fluid communication between at least one of said upstream manifold passages and at least one of said downstream manifold passages in said plate member.

9. A rotary fluid pressure device of the type having a housing means defining a fluid inlet and a fluid outlet, a fluid displacement means including a first member and a second member, operably associated with said first member; said first member and said second member having relative movement, and interengaging to define a plurality N of expanding and contracting fluid volume chambers in response to said relative movement; a valve member providing fluid communication between said fluid inlet and said expanding volume chambers, and between said fluid outlet and said contracting volume chambers; a plate member defining a plurality N of upstream fluid passages in commutating fluid communication with said valve member and a plurality N of downstream fluid passages, with each said downstream fluid passage being in open fluid communication with one of said plurality of volume chambers; a plurality M of upstream fluid passages being in direct, relatively unrestricted, continuous fluid communication with a plurality M of downstream fluid passages; characterized by:

(a) a plate assembly including said plate member, at least one cover plate assembly, and at least one control valve assembly;

(b) said plate member including a plurality M of upstream manifold passages being in open fluid communication with a plurality M of upstream fluid passages and having an opening in an exterior surface of said plate member and a plurality M of downstream manifold passages being in fluid communication with a plurality M of downstream fluid passages and having an opening in said exterior surface of said plate member; wherein:

(i) said cover plate assembly defining a mounting surface being in sealing engagement with said exterior surface of said plate member with said cover plate assembly providing unrestricted fluid communication between at least one of said upstream passages and at least one of said downstream passages in said plate member; and (ii) said control valve assembly defining a mounting surface being in sealing engagement with said exterior surface of said plate member with said control valve assembly being operable in a first position to provide relatively unrestricted fluid communication between at least one of said upstream manifold passages and at least one of said downstream manifold passages in said plate member, and operable in a second position to block fluid communication between at least one of said upstream manifold passages and at least one of said downstream manifold passages in said plate member.

10. A rotary fluid pressure device as claimed in claim 9, characterized by said cover plate assembly having a plurality of separate plates, each defining a mounting surface being in sealing engagement with said exterior surface of said plate member.

11. A rotary fluid pressure device as claimed in claim 9, characterized by said fluid displacement means being of the gerotor type.

12. A rotary fluid pressure device as claimed in claim 11, characterized by said valve member being of the disc valve type.

13. A rotary fluid pressure device as claimed in claim 9, characterized by a transverse surface of said plate member being in direct commutating fluid communication with said valve member.

14. A rotary fluid pressure device as claimed in claim 9, characterized by said control valve assembly being operable in said second position to provide relatively unrestricted fluid communication between each of said plurality of downstream manifold passages.

15. A rotary fluid pressure device as claimed in claim 14, characterized by said control valve assembly defining a passage in fluid communication with a source of pressurized fluid.

16. A rotary fluid pressure device as claimed in claim 15, characterized by said passage in the control valve assembly being in fluid communication with a pressurized fluid passage in said plate member.

17. A rotary fluid pressure device comprising:

a displacement mechanism;

a valve member in selective fluid communication with the displacement mechanism;

a plate assembly including:

a plate member having a manifold surface, the plate member defining an upstream manifold passage in fluid communication with the valve member and a downstream manifold passage in fluid communication with the displacement mechanism, the manifold surface defines a first fluid passage opening in fluid communication with the upstream manifold passage and a second fluid passage opening in fluid communication with the downstream manifold passage;

a cover plate in selective engagement with the manifold surface of the plate member, the cover plate having a mounting surface defining a fluid groove that provides fluid communication between the first and second fluid passage openings.

18. The rotary fluid pressure device as claimed in claim 17, wherein the plate assembly is disposed between the displacement mechanism and the valve member.

19. The rotary fluid pressure device of claim 17, further comprising a control spool assembly, the control spool assembly being adapted to provide fluid communication between the upstream and downstream manifold passages of the plate member in a first position and to block fluid communication between the upstream and downstream manifold passages in a second position when the control spool assembly, wherein the control spool assembly is selectively interchangeable with the cover plate.

20. The rotary fluid pressure device of claim 17, wherein the valve member is of a disc-valve type.

21. A method for converting a single-speed rotary fluid pressure device to a multi-speed rotary fluid pressure device, the method comprising:

providing a rotary fluid pressure device having:

a displacement mechanism;

a valve member in fluid communication with the displacement mechanism;

a plate assembly including a plate defining an upstream manifold passage in fluid communication with the valve member and a downstream manifold passage in fluid communication with the displacement mechanism;

removing a cover plate from a manifold surface of the plate member, the cover plate including a mounting surface defining a fluid groove that is adapted to provide fluid communication between the upstream and downstream manifold passages of the plate when mounted to the manifold surface; and mounting a control valve assembly to the manifold surface of the plate, the control valve assembly being adapted to provide fluid communication between the upstream and downstream manifold passages of the plate in a first position and to block fluid communication between the upstream and downstream manifold passages in a second position.

22. A method as claimed in claim 21, wherein the plate defines a plurality of upstream manifold passages and a plurality of downstream manifold passages.

23. A method as claimed in claim 22, wherein the cover plate defines a plurality of fluid grooves.

24. A method as claimed in claim 21, wherein the displacement mechanism is of a gerotor-type.

25. A method as claimed in claim 21, wherein the control valve assembly includes:

a spool block defining a spool bore, the spool block including a mounting surface; and a control valve spool disposed in the spool bore.

26. A method as claimed in claim 25, wherein the spool block defines a first plurality of control passages and a second plurality of control passages, the first plurality of control passages being in fluid communication with the upstream manifold passages when the control valve assembly is mounted to the manifold surface, the second plurality of control passages being in fluid communication with the downstream manifold passages when the control valve assembly is mounted to the manifold surface.

27. A method as claimed in claim 26, wherein the spool block defines a plurality of high-pressure passages that is in fluid communication with the downstream manifold passages in the second position.

* * * * *